US009028045B2

(12) United States Patent
Shimizu

(10) Patent No.: US 9,028,045 B2
(45) Date of Patent: May 12, 2015

(54) IMAGE FORMING APPARATUS

(71) Applicant: Kenji Shimizu, Kanagawa (JP)

(72) Inventor: Kenji Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/855,271

(22) Filed: Apr. 2, 2013

(65) Prior Publication Data

US 2013/0271527 A1 Oct. 17, 2013

(30) Foreign Application Priority Data

Apr. 11, 2012 (JP) ..... 2012-090438
Feb. 15, 2013 (JP) ..... 2013-027319

(51) Int. Cl.
*B41J 23/00* (2006.01)
*B41J 19/00* (2006.01)

(52) U.S. Cl.
CPC ..... *B41J 23/00* (2013.01); *B41J 19/005* (2013.01)

(58) Field of Classification Search
USPC ..... 347/37
See application file for complete search history.

(56) References Cited

U.S. PATENT DOCUMENTS 4,787,759 A * 11/1988 Geis et al. ..... 400/55
6,450,710 B1 * 9/2002 Foster et al. ..... 400/58
2002/0159808 A1 * 10/2002 Smith ..... 400/283
2009/0122094 A1 * 5/2009 Tsumoto ..... 347/8
2011/0199430 A1 * 8/2011 Yajima et al. ..... 347/37
2012/0056936 A1 3/2012 Shimizu et al.
2012/0062649 A1 3/2012 Naruse et al.
2012/0306960 A1 12/2012 Niihara et al.
2012/0306967 A1 12/2012 Shimizu et al.
2012/0306970 A1 12/2012 Naruse et al.

FOREIGN PATENT DOCUMENTS

JP 2010-089485 4/2010
JP 2011-173416 9/2011

OTHER PUBLICATIONS

U.S. Appl. No. 13/610,579, filed Sep. 11, 2012, Masato Ogawa, et al.

* cited by examiner

*Primary Examiner* — Stephen Meier
*Assistant Examiner* — Alexander D Shenderov
(74) *Attorney, Agent, or Firm* — Cooper & Dunham LLP

(57) ABSTRACT

An image forming apparatus including a recording head to form an image on a recording medium, a carriage mounting the recording head and movable in a main scanning direction, a guide member extending in the main scanning direction to movably hold and guide the carriage, a stay member extending in the main scanning direction to hold the guide member, a frame member attached to the stay member to support the stay member, and an adjustment unit provided between and attached to a first end of the stay member and to the frame member to adjust an angle of the stay member with respect to the recording medium.

5 Claims, 6 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application Nos. 2012-090438, filed on Apr. 11, 2012, and 2013-027319, filed on Feb. 15, 2013, both in the Japan Patent Office, the entire disclosures of which are hereby incorporated by reference herein.

BACKGROUND

1. Technical Field

Exemplary aspects of the present invention generally relate to an image forming apparatus, and more particularly to an image forming apparatus including a carriage that mounts a recording head thereon.

2. Related Art

One type of image forming apparatus, such as a printer, copier, plotter, facsimile machine, or multifunction device having two or more of these capabilities is an inkjet recording device employing a liquid ejection recording method. The inkjet recording device includes a recording head constructed of a liquid ejection head that ejects droplets of a recording liquid such as ink onto a sheet of a recording medium to form an image on the sheet.

There is known an inkjet recording device that further includes a carriage that mounts the recording head thereon, a carriage rail that supports the carriage slidably in a main scanning direction and rotatably in a rotation direction perpendicular to the main scanning direction, a guide rail extending in the main scanning direction to restrict a position of the carriage relative to the carriage rail in the rotation direction, an adjustment member to which the guide rail is fastened, a support member to which the adjustment member is fastened, a first adjustment mechanism that moves the guide rail relative to the adjustment member in a direction intersecting with the main scanning direction to adjust the position of the guide rail, and a second adjustment mechanism that moves the adjustment member relative to the support member in the direction intersecting with the main scanning direction to adjust relative positions of the adjustment member and the guide rail. The first adjustment mechanism has multiple adjustment portions that move the guide rail relative to the adjustment member, and the second adjustment mechanism has multiple adjustment portions that move the adjustment member relative to the support member.

A guide member that guides the carriage is often held by a stay member extending in the main scanning direction or by a configuration in which both ends of the guide member are attached to lateral plates of the image forming apparatus. In the former case, in which the guide member is held by the stay member, a twist in the stay member or an inclination of the stay member relative to a surface of the recording medium, on which an image is formed by the recording head, causes a gap between the surface of the recording medium and a nozzle face of the recording head mounted on the carriage guided by the guide member to fluctuate in size, thereby degrading image quality.

It is conceivable that the above-described problem can be solved by correcting the position of the guide rail and the twist or inclination of the stay member. However, in the related-art configuration of the image forming apparatus described above, although the position of the guide rail in the direction perpendicular to the main scanning direction is correctible, the twist in the stay member in the main scanning direction and the angle of the stay member relative to the surface of the recording medium are not correctible.

SUMMARY

In view of the foregoing, illustrative embodiments of the present invention provide a novel image forming apparatus in which a twist in a stay member that holds a guide member and an angle of the stay member relative to a surface of a recording medium are corrected to improve image quality.

In one illustrative embodiment, an image forming apparatus includes a recording head to form an image on a recording medium, a carriage mounting the recording head and movable in a main scanning direction, a guide member extending in the main scanning direction to movably hold and guide the carriage, a stay member extending in the main scanning direction to hold the guide member, a frame member attached to the stay member to support the stay member, and an adjustment unit provided between and attached to a first end of the stay member and to the frame member to adjust an angle of the stay member with respect to the recording medium.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
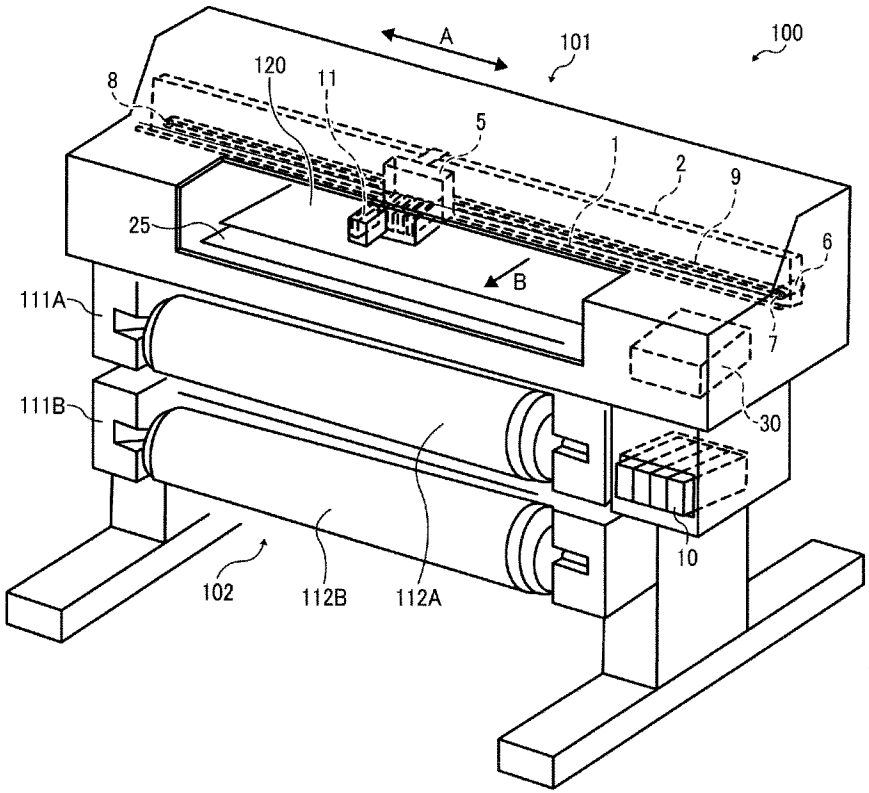
FIG. 1 is a perspective view illustrating the external appearance of an example of an image forming apparatus according to an illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that has substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a "sheet" of recording media is not limited to a sheet of paper but also includes any material onto which liquid droplets including ink droplets adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns.

In addition, ink includes any material which is a liquid when ejected from the image forming apparatuses to form images on the recording medium, such as a DNA sample, a resist material, a pattern material, and resin.

Further, an image formed on the recording medium is not limited to a flat image, but also includes an image formed on a three-dimensional object, a three-dimensional image, and so forth.

Figure 2:
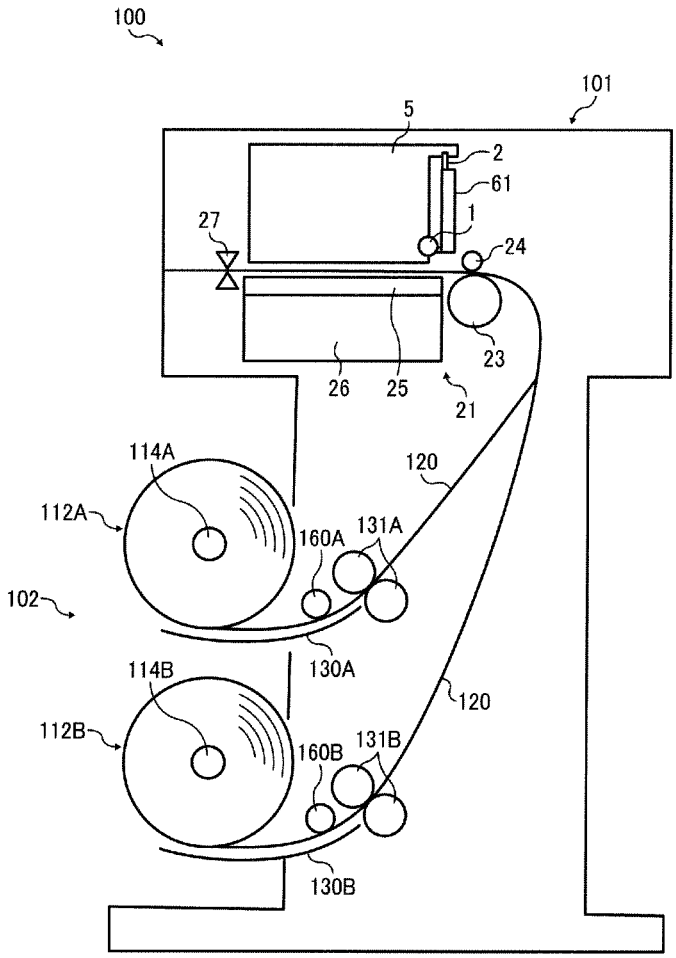
FIG. 2 is a vertical cross-sectional view illustrating the configuration of the image forming apparatus illustrated in FIG. 1.
Figure 3:
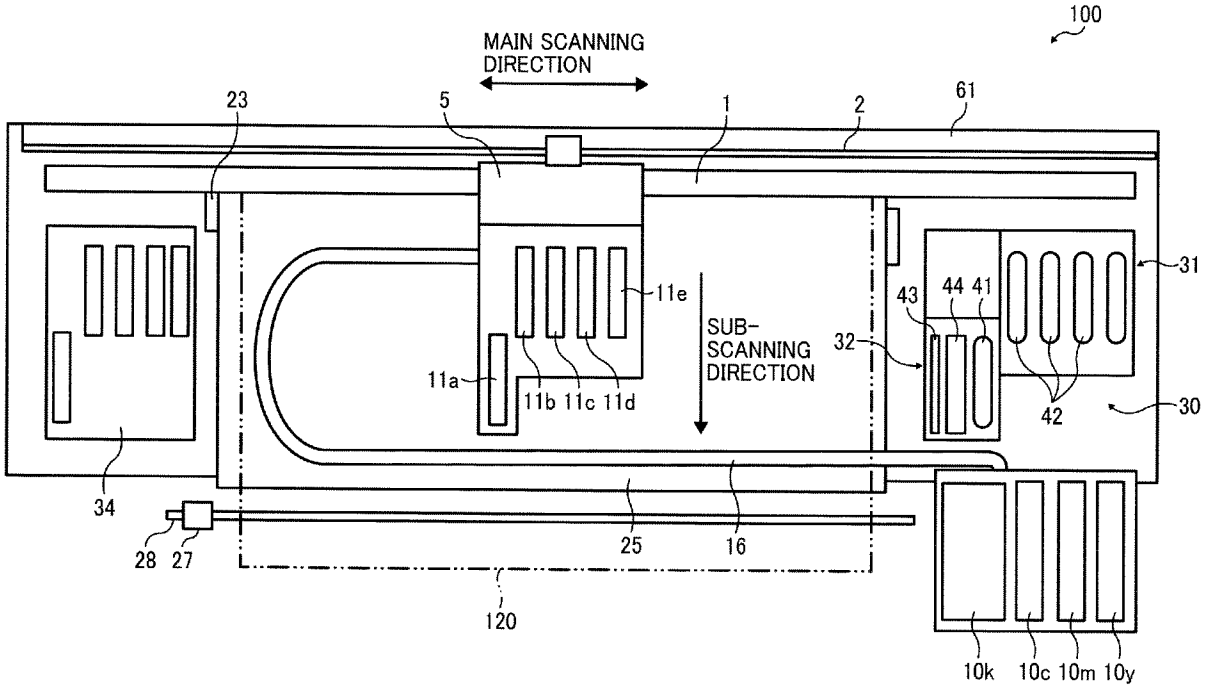
FIG. 3 is a schematic plan view illustrating an example of a configuration of a mechanical portion of the image forming apparatus illustrated in FIG. 1.
Figure 4:
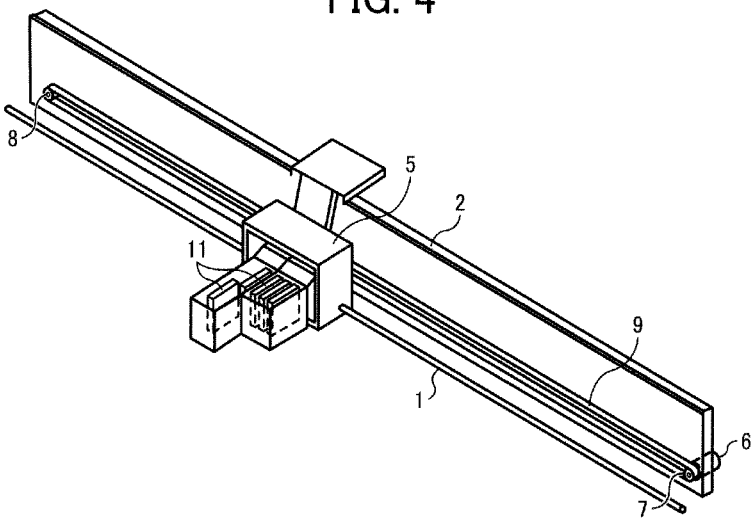
FIG. 4 is a perspective view of the mechanical portion of the image forming apparatus.

A description is now given of a configuration and operation of an image forming apparatus 100 according to an illustrative embodiment, with reference to FIGS. 1 to 4. FIG. 1 is a perspective view illustrating an example of an outer appearance of the image forming apparatus 100 according to the illustrative embodiment. FIG. 2 is a vertical cross-sectional view illustrating the configuration of the image forming apparatus 100. FIG. 3 is a schematic plan view illustrating an example of a configuration of a mechanical portion of the image forming apparatus 100. FIG. 4 is a perspective view of the mechanical portion of the image forming apparatus 100.

The image forming apparatus 100 is a serial-type inkjet recording device and is constructed of a body 101 and a sheet feeder 102 disposed below the body 101.

In the mechanical portion of the body 101, a carriage 5 is slidably held by a guide member, which, in the present illustrative embodiment, is a guide rod 1, and a guide stay 2, both of which are extended across a main scanning direction indicated by arrow A in FIG I.

A main scanning mechanism that drives the carriage 5 includes a drive motor 6 provided at one end in the main scanning direction, a drive pulley 7 rotatively driven by the drive motor 6, a driven pulley 8 provided at the other end in the main scanning direction, and a timing belt 9 wound around the drive pulley 7 and the driven pulley 8.

Recording heads 11*a*,11*b*, 11*c*, 11*d*, and 11*e* (hereinafter collectively referred to as recording heads 11), each constituted of a liquid ejection head that ejects ink droplets of a specific color, that is, black (K), magenta (M), cyan (C), or yellow (Y) and a head tank, not shown, that supplies ink to the corresponding recording head 11, are mounted on the carriage 5. Nozzle arrays each constituted of multiple nozzles are provided to a nozzle face 110 (shown in FIG. 5) of each of the liquid droplet ejection heads and arrayed in a sub-scanning direction perpendicular to the main scanning direction, such that the recording heads 11 eject ink droplets of the specified colors vertically downward, respectively.

The recording head 11*a* is offset from the rest of the recording heads 11*b* to 11*e* by a single nozzle array in the sub-scanning direction. Two nozzle arrays are formed in each of the recording heads 11. Black ink droplets are ejected from the recording heads 11*a* and 11*b*, and magenta, cyan, and yellow ink droplets are ejected from the recording heads 11*c*, 11*d*, and 11*e*, respectively.

During monochrome image formation, the recording heads 11*a* and 11*b* are used so that an image with a total length of two recording heads 11*a* and 11*b* in the sub-scanning direction can be formed by a single reciprocal movement of the carriage 5 in the main scanning direction. During full-color image formation, for example, the recording heads 11*b*, 11*c*, 11*d*, and 11*e* are used.

Ink is supplied from ink cartridges 10*k*, 10*c*, 10*m*, or 10*y* (hereinafter collectively referred to as ink cartridges 10), each detachably installable in the body 101 of the image forming apparatus 100, to the head tanks included in the recording heads 11, respectively, through a supply tube 16. At this time, black ink is supplied from the ink cartridge 10*k* to both the recording heads 11*a* and 11*b*.

The carriage 5 has a main scanning range through which it scans, and within this range is a recording range. A sheet 120 fed from the sheet feeder 102 is intermittently conveyed to the recording range by a conveyance part 21 in a sheet conveyance direction indicated by arrow B in FIG. 1. The sheet conveyance direction is perpendicular to the main scanning direction of the carriage 5 and identical to the sub-scanning direction.

The conveyance part 21 includes a conveyance roller 23 that conveys the sheet 120 fed from the sheet feeder 102, a pressing roller 24 provided opposite the conveyance roller 23, a conveyance guide member 25 in which multiple suction holes are formed, and a suction fan 26. The sheet 120 conveyed by the conveyance roller 23 is sucked by the suction fan 26 through the suction holes formed in the conveyance guide member 25.

A cutter 27 that cuts the sheet 120, on which an image is formed by the recording heads 11, to a predetermined length is disposed downstream from the conveyance part 21 in the sheet conveyance direction.

Although being mounted on a timing belt 28 in the present illustrative embodiment, alternatively, the cutter 27 may be fixed to a wire. The timing belt 28 is wound around a drive pulley driven by a drive motor, not shown, and a driven pulley, and is moved in the main scanning direction by the drive motor via the drive pulley so that the cutter 27 cuts the sheet 120 to the predetermined length.

A maintenance/recovery mechanism 30 that maintains the nozzles of the recording heads 11 is provided next to the conveyance guide member 25 at one end of the image forming apparatus 100 in the main scanning direction. An ink receiver 34 to which ink droplets not used for image formation are ejected in order to remove viscous ink from the nozzles is provided next to the conveyance guide member 25 at the other end of the image forming apparatus 100 in the main scanning direction.

The maintenance/recovery mechanism 30 includes a first unit 31 held by a frame of the body 101 of the image forming apparatus 100 and a second unit 32 movably held by a frame of the maintenance/recovery member 30. The second unit 32 is reciprocally movable back and forth in the sub-scanning direction. During maintenance/recovery of the recording head 11*a*, the second unit 32 is at a position as illustrated in FIG. 2. During maintenance/recovery of the recording heads

11*b* to 11*e*, the second unit 32 is moved in the sub-scanning direction to a position of the first unit 31.

The maintenance/recovery mechanism 30 further includes a suction cap 41 and moisture caps 42, each of which covers the nozzle face 110 of each of the recording heads 11, a wiper 43 that wipes off the nozzle face 110, and an ink receiver 44 to which ink droplets not used for image formation are ejected in order to remove viscous ink from the nozzles. The suction cap 41 functions also as a moisture cap.

The sheet feeder 102 includes an upper spool bearing stand 111A and a lower spool bearing stand 111B disposed one above the other. It is to be noted that, in FIGS. 1 and 2, suffixes A and B refer to components for the upper and lower spool bearing stands 111A and 111B, respectively. Because both the upper and lower spool bearing stands 111A and 111B have the same basic configuration, suffixes A and B are omitted in the description below. Each spool bearing stand 111 includes a mechanism that feeds the sheet 120 from a sheet roll 112 accommodated within the spool bearing stand 111.

The sheet roll 112 is constituted as one long continuous sheet 120 wound around a core 114.

The sheet roll 112 set to the spool bearing stand 111 is rotated so that the sheet 120 is fed along a guide member 130.

A pair of conveyance rollers 131 is provided downstream from the spool bearing stand 111, and the sheet 120 fed from the sheet roll 112 is curved and conveyed upward by the pair of conveyance rollers 131. A driven roller 160 that contacts an upper surface of the sheet 120 fed from the sheet roll 112 to be rotated as the sheet 120 is conveyed is provided between the spool bearing stand 111 and the pair of conveyance rollers 131. The guide member 130 is also disposed between the spool bearing stand 111 and the pair of conveyance rollers 131 to guide a lower surface of the sheet 120 to the pair of conveyance rollers 131.

While being conveyed, the sheet 120 fed from the sheet roll 112 by rotation of the pair of conveyance rollers 131 extends between the sheet roll 112 and the pair of conveyance rollers 131 via the driven roller 160. After passing through the pair of conveyance rollers 131, the sheet 120 is further conveyed to a nip between the conveyance roller 23 and the pressing roller 24 of the conveyance part 21.

The sheet 120 fed from the sheet feeder 102 is then intermittently conveyed by the conveyance part 21. The recording heads 11 are driven based on image data while the carriage 5 is moved in the main scanning direction so that ink droplets are ejected from the recording heads 11 onto the sheet 120, which remains stationary, so as to form a single line of an image to be formed on the sheet 120. Thereafter, the conveyance part 21 conveys the sheet 120 by a predetermined amount to perform image formation of the next line. The above-described processes are repeated to form the image on the sheet 120. The sheet 120 having the image formed thereon is then cut to a predetermined length by the cutter 27 and is discharged to a discharge tray, not shown, provided on the front side of the body 101 of the image forming apparatus 100.

Figure 5:
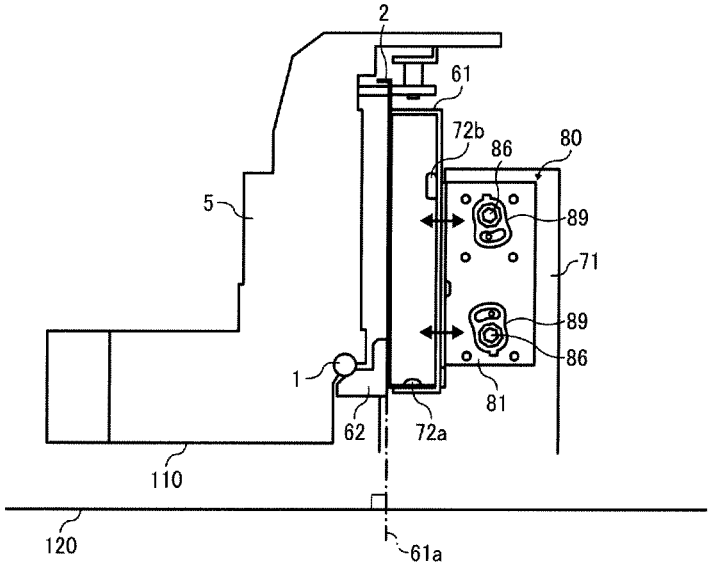
FIG. 5 is a schematic view illustrating relative positions of a sheet and a stay member in the image forming apparatus.
Figure 6:
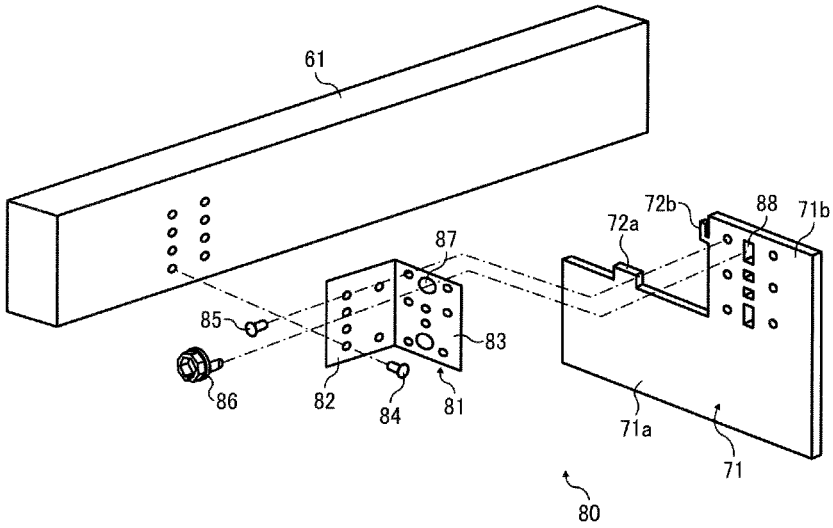
FIG. 6 is an exploded view illustrating relative positions of the stay member, a frame member, and an adjustment unit included in the image forming apparatus.
Figure 7:
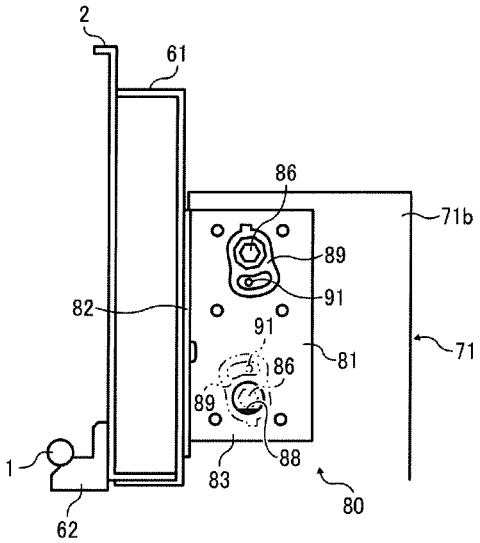
FIG. 7 is an end view of the stay member and the frame member.
Figure 8:
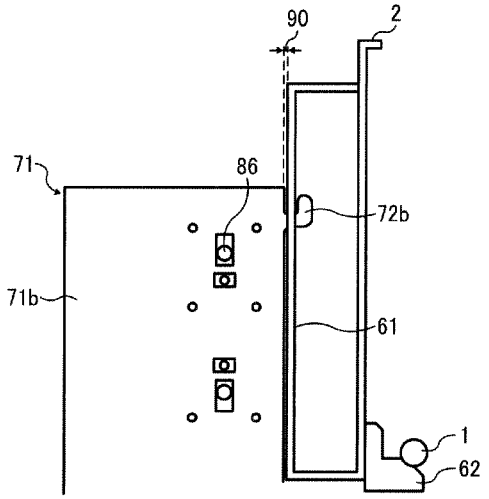
FIG. 8 is an end view of the stay member and the frame member viewed from a different angle from FIG. 7.

A description is now given of features of the present illustrative embodiment. FIG. 5 is a schematic view illustrating relative positions of the sheet 120 and a stay member 61. FIG. 6 is an exploded view illustrating relative positions of the stay member 61, a frame member 71, and an adjustment unit 80. FIG. 7 is an end view of the stay member 61 and the frame member 71. FIG. 8 is an end view of the stay member 61 and the frame member 71 viewed from a different angle from FIG. 7.

The stay member 61 is formed of a metal plate bent to have a box-like shape in cross-section, and extends across a direction of movement of the carriage 5, that is, the main scanning direction. The stay member 61 holds the guide rod 1, which movably guides a lower part of the carriage 5, at multiple positions in the main scanning direction with holding members 62. The guide stay 2 that movably guides an upper part of the carriage 5 is fixed to the stay member 61 with screws.

Both ends of the stay member 61 in the main scanning direction are supported by frame members 71, respectively. As illustrated in FIG. 6, each frame member 71 is L-shaped and constructed of a horizontal portion 71*a* having a protrusion 72*a* and a vertical portion 71*b* having a hook 72*b*. Each end of the stay member 61 in the main scanning direction is fitted onto the protrusion 72*a* and the hook 72*b* of the frame member 71 to be supported by the frame member 71. There is a slight gap 90 between the vertical portion 71*b* of the frame member 71 and the stay member 61 as illustrated in FIG. 8.

The adjustment unit 80 that adjusts an inclination of the stay member 61 with respect to a surface of the sheet 120 conveyed by the conveyance part 21 (hereinafter referred to as a sheet conveyance surface) is provided between the stay member 61 and the frame member 71.

The adjustment unit 80 includes an adjustment plate 81 bent in an L-shape and constructed of a first face 82, to which the stay member 61 is attached, and a second face 83 to be attached to the frame member 71. It is to be noted that, although one end of the stay member 61 in the main scanning direction is shown in the drawings, the adjustment unit 80 is provided to both ends of the stay member 61 in the main scanning direction between the stay member 61 and the frame members 71, respectively, and therefore the frame plate 81 is also provided to both ends in the main scanning direction.

The first face 82 of the adjustment plate 81 is fixed to the stay member 61 with multiple screws 84. The second face 83 of the adjustment plate 81 is loosely fixed to the frame member 71 with multiple screws 85. Specifically, the screws 85 are fastened into screws holes formed in the frame member 71 with play, respectively, such that the adjustment plate 81 is loosely fixed to the frame member 71 to be movable relative to the frame member 71.

The adjustment unit 80 further includes an adjustment member, which, in the present illustrative embodiment, is a pin member 86 that adjusts the position of the adjustment plate 81. Each adjustment plate 81 is provided with multiple adjustment members, and in the present illustrative embodiment, two pin members 86 of identical structure are provided for each adjustment plate 81.

Figure 9A:
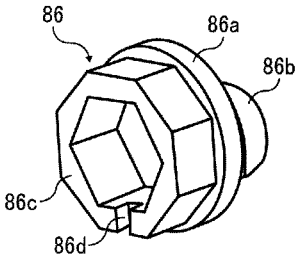
FIG. 9A is a perspective view of a pin member included in the adjustment unit.
Figure 9B:
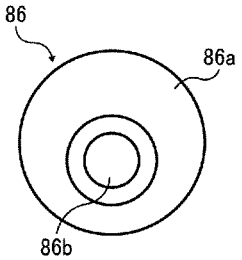
FIG. 9B is an end view of the pin member viewed from a different angle from FIG. 9A.

FIG. 9A is a perspective view of one of the pin members 86. FIG. 9B is an end view of the pin member 86 viewed from a different angle from FIG. 9A. As illustrated in FIGS. 9A and 9B, each pin member 86 is an eccentric member constructed of an operating part 86*a* that engages a circular insertion hole 87 formed in the second face 83 of the adjustment plate 81, and a pin 86*b* provided eccentric from the operating part 86*a* to engage an insertion hole (or recessed portion) 88 formed in the frame member 71. The operating part 86*a* is integrated with a polygonal portion 86*c* having a notch 86*d* in one side thereof.

Figure 10:
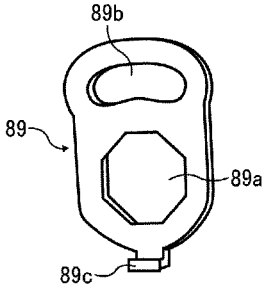
FIG. 10 is a perspective view of a bracket.

A bracket 89 is provided to the second face 83 of the adjustment plate 81. FIG. 10 is a perspective view of the bracket 89.

As illustrated in FIG. 10, the bracket 89 has a polygonal insertion hole 89*a* that engages the polygonal portion 86*c* of the pin member 86, an arc-shaped slot 89*b* above the insertion hole 89*a* and into which a screw 91 is inserted and fastened to fix the second face 83 of the adjustment plate 81 to the frame member 71, and a protrusion 89*c* below the insertion hole 89*a* that is fitted onto the adjustment plate 81.

As shown in FIG. 5, the pin members 86 are provided at multiple positions, which, in the present illustrative embodiment, are two positions, respectively, on the same straight line in the vertical direction perpendicular to the sheet conveyance surface.

Because the pin 86*b* is eccentric from the operating part 86*a*, rotation of the pin members 86 moves the adjustment plate 81 along the sheet conveyance direction within a plane perpendicular to the main scanning direction by an amount of play with the frame member 71.

Movement of the adjustment plate 81 moves the stay member 61, which is fixed to the adjustment plate 81, in directions indicated by double-headed arrows in FIG. 5 along the sheet conveyance direction.

As a result, a perpendicularity of the stay member 61 with respect to the sheet conveyance surface and a twist in the stay member 61 in the main scanning direction are corrected, so that the stay member 61 has appropriate inclination with respect to the sheet conveyance surface.

A description is now given of the perpendicularity of the stay member 61 with respect to the sheet conveyance surface.

It is to be noted that the stay member 61 holds the guide rod 1 with a holding face 61*a* thereof provided with the holding members 62 and the guide stay 2, and in the present illustrative embodiment, an angle of the stay member 61 with respect to the sheet conveyance surface refers to an angle between the sheet conveyance surface and the holding face 61*a* of the stay member 61. A portion of the stay member 61 that holds the carriage 5 and the guide rod 1 requires the most precise perpendicularity with respect to the sheet conveyance surface.

An inclination of the nozzle face 110 of the recording head 11 relative to the sheet conveyance surface displaces positions of the ink droplets ejected from the nozzles of the recording head 11.

In the present illustrative embodiment, the carriage 5 mounting the recording heads 11 thereon is held by the guide rod 1 supported by the stay member 61. Therefore, the inclination of the stay member 61 relative to the sheet conveyance surface inclines the nozzle face 110 of the recording head 11 relative to the sheet conveyance surface.

For this reason, preferably, the stay member 61 remains perpendicular to the sheet. However, it is to be noted that, alternatively, the stay member 61 may not be precisely perpendicular to the sheet conveyance surface as long as the nozzle face 110 of the recording head 11 is correctible not to incline relative to the sheet conveyance surface.

A description is now given of adjustment of a twist generated in the stay member 61.

It is to be noted that, in the present illustrative embodiment, the twist in the stay member 61 refers to a twist in the stay member 61 around an axis thereof in the main scanning direction.

Rotation of the pin members 86 moves the stay member 61 in the sheet conveyance direction in the processes described below.

The pin 86*b*, which is eccentric from the center of rotation of the pin member 86, is fitted into the insertion hole 88 formed in the frame member 71. A width of the insertion hole 88 in the sheet conveyance direction is slightly larger than a diameter of the pin 86*b*.

When the pin member 86 is rotated, the pin 86*b* contacts a wall of the insertion hole 88 m the sheet conveyance direction. When the pin member 86 is further rotated, the pin 86*b* pushes against the wall of the insertion hole 88, so that a reaction force moves the adjustment plate 81, which is loosely fixed to the frame member 71 with the pin member 86, relative to the frame member 71 in a direction opposite the direction in which the pin 86*b* pushes against the wall of the insertion hole 88. As a result, the stay member 61, to which the adjustment plate 81 is fixed, is moved relative to the frame member 71 in the sheet conveyance direction.

The insertion hole 88 has a rectangular shape in which a length in the direction perpendicular to the sheet conveyance direction is longer than the width in the sheet conveyance direction. Thus, top and bottom walls of the insertion hole 88 are not contacted by the pin 86*b* during the rotation of the pin member 86.

When both ends of the stay member 61 are fixed to the frame members 71 via the adjustment plates 81, respectively, in a state in which the vertical part 71*b* of the frame member 71 at one end is inclined relative to the sheet conveyance surface while the vertical part 71*b* of the frame member 71 at the opposite end is not inclined, or in a case in which the vertical parts 71*b* of the frame members 71 at both ends of the stay member 61 are inclined relative to the sheet conveyance surface at different angles, the stay member 61 is twisted around the axis thereof in the main scanning direction.

In the above-described cases, one or both of the adjustment members 80 are used to adjust the angle of the stay member 61 with respect to the sheet conveyance surface such that both ends of the stay member 61 are perpendicular to the sheet conveyance surface, respectively. The same angle of the stay member 61 at both ends, with respect to the sheet conveyance surface, prevents the twist in the stay member 61.

A description is now given of a configuration and use of the bracket 89.

The slot 89*b* of the bracket 89 restricts an amount of rotation of the pin member 86. When the pin member 86 is rotated, the bracket 89 is also rotated so that a wall of the slot 89*b* contacts the screw 91 to restrict the rotation of the bracket 89.

Because the pin members 86 are positioned on the same straight line in the vertical direction, the stay member 61 is moved via the adjustment members 81 along the sheet conveyance direction while the vertical movement of the stay member 61 is restricted.

At the same time, a different amount of rotation between the upper pin member 86 and the lower pin member 86 rotates the stay member 61 around the main scanning direction, thereby correcting the position of the stay member 61 in the direction of rotation of the stay member 61.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus, comprising:

a recording head to form an image on a recording medium, wherein the recording medium bearing the image formed thereon is discharged from a body of the image forming apparatus in a discharge direction towards a front side of the body of the image forming apparatus;

a carriage mounting the recording head thereon and movable in a main scanning direction;

a guide member extending in the main scanning direction to movably hold and guide the carriage;

a stay member provided on a back side of the guide member, as viewed from the front side of the body of the image forming apparatus, and extending in the main scanning direction to hold the guide member;

a frame member attached to the stay member to support the stay member; and an adjustment unit provided on a back side of the stay member, as viewed from the front side of the body of the image forming apparatus, and attached both to a first end of the stay member and to the frame member, to adjust an angle of the stay member with respect to the recording medium.

2. The image forming apparatus according to claim 1, wherein the adjustment unit comprises:

an adjustment plate L-shaped in cross-section and having a first face fixed to the stay member and a second face movably attached to the frame member; and an adjustment member that moves the adjustment plate to adjust the position of the adjustment plate relative to the frame member.

3. The image forming apparatus according to claim 2, further comprising a second adjustment plate provided to a second end of the stay member opposite the first end in the main scanning direction.

4. The image forming apparatus according to claim 2, wherein the adjustment member comprises an eccentric member.

5. The image forming apparatus according to claim 2, further comprising a second adjustment member provided for the adjustment plate, wherein the first adjustment member and the second adjustment member are vertically aligned on the same straight line.

* * * * *